US007891505B2

(12) United States Patent
Bowers et al.

(10) Patent No.: US 7,891,505 B2
(45) Date of Patent: Feb. 22, 2011

(54) DISPLAY FOR A CASKET SELECTION ROOM

(75) Inventors: David Bowers, Cincinnati, OH (US); Jane J. Browe, Cincinnati, OH (US); Kevin R. Buchler, Fairfield, OH (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 12/427,153

(22) Filed: Apr. 21, 2009

(65) Prior Publication Data

US 2009/0243449 A1 Oct. 1, 2009

Related U.S. Application Data

(62) Division of application No. 11/760,593, filed on Jun. 8, 2007, now Pat. No. 7,520,395, which is a division of application No. 10/757,431, filed on Jan. 15, 2004, now abandoned.

(51) Int. Cl.
*A47G 29/00* (2006.01)

(52) U.S. Cl. ..... 211/85.16; 211/78

(58) Field of Classification Search ..... 211/13.1, 211/189, 163, 78, 70, 119.002, 85.16, 85.27; 27/1, 2, 10
See application file for complete search history.

(56) References Cited

U.S. PATENT DOCUMENTS

| | | | | | |
|---|---|---|---|---|---|
| 518,335 | A | * | 4/1894 | Sherman | 312/314 |
| 788,459 | A | * | 4/1905 | Perle et al. | 211/78 |
| 790,440 | A | * | 5/1905 | Klein | 211/45 |
| 1,842,286 | A | * | 1/1932 | Potter | 312/293.2 |
| 1,908,928 | A | * | 5/1933 | Stein | 211/78 |
| 2,665,184 | A | * | 1/1954 | Hord | 221/84 |
| 3,190,243 | A | * | 6/1965 | Pira | 108/152 |
| 3,191,320 | A | * | 6/1965 | Copeland et al. | 434/79 |
| 3,855,943 | A | * | 12/1974 | Larson | 108/28 |
| 4,082,384 | A | * | 4/1978 | Dold | 312/3 |
| 4,140,223 | A | * | 2/1979 | Rau et al. | 211/78 |
| 4,140,224 | A | * | 2/1979 | Celeste | 211/134 |
| 4,160,570 | A | * | 7/1979 | Bridges | 312/245 |
| 4,304,076 | A | * | 12/1981 | Splendora | 52/104 |

(Continued)

FOREIGN PATENT DOCUMENTS

| | | |
|---|---|---|
| FR | 2542492 | 9/1984 |

(Continued)

OTHER PUBLICATIONS

Batesville Casket Company, Inc., Applied Retail Systems, Partnership Marketing Program, 38 pages, undated.

(Continued)

*Primary Examiner*—Jennifer E. Novosad
(74) *Attorney, Agent, or Firm*—Wood, Herron & Evans, LLP

(57) ABSTRACT

A display for a casket selection room comprises a base, a first display portion mounted to the base, a plurality of casket portions representing a plurality of casket choices from which a customer may select mounted to the first display portion, a second display portion mounted to the first display portion, and a plurality of casket ornaments representing a plurality of ornament choices from which the customer may select mounted to the second display portion.

14 Claims, 8 Drawing Sheets

U.S. PATENT DOCUMENTS 4,403,700 A * 9/1983 Manlove ..... 211/88.01
4,508,231 A * 4/1985 Honickman ..... 211/199
4,548,324 A * 10/1985 Mackey, Jr. ..... 211/58
4,615,448 A * 10/1986 Johnstonbaugh ..... 211/94.01
4,673,090 A * 6/1987 Crosslen ..... 211/183
4,688,359 A * 8/1987 See ..... 52/134
4,825,601 A * 5/1989 Halverson ..... 52/36.4
4,930,628 A * 6/1990 Bridges ..... 206/45.23
5,333,744 A * 8/1994 LoCicero et al. ..... 211/87.01
5,405,017 A * 4/1995 Szabo et al. ..... 211/13.1
5,495,954 A * 3/1996 Schmit ..... 211/90.04
D369,034 S * 4/1996 Davet ..... D6/457
5,524,394 A * 6/1996 Szabo et al. ..... 52/36.1
5,526,943 A * 6/1996 Thompson ..... 211/87.01
5,622,010 A * 4/1997 Weber ..... 52/36.4
5,707,126 A * 1/1998 Neufeld et al. ..... 312/245
5,709,052 A * 1/1998 Szabo et al. ..... 52/36.1
5,755,499 A * 5/1998 Hillesland ..... 312/272.5
5,759,045 A * 6/1998 Gabig et al. ..... 434/367
5,787,626 A * 8/1998 Bingham et al. ..... 40/735
D398,026 S * 9/1998 Riga ..... D20/29
D398,027 S * 9/1998 Riga ..... D20/29
D398,654 S * 9/1998 Riga ..... D20/29
5,800,027 A * 9/1998 Dunn ..... 312/138.1
D399,880 S * 10/1998 Riga ..... D20/29
5,848,498 A * 12/1998 Szabo et al. ..... 52/36.1
5,848,698 A * 12/1998 Stompe ..... 206/449
D405,583 S * 2/1999 Zimmerman ..... D99/9
5,901,862 A * 5/1999 Riga et al. ..... 211/85.16
6,070,741 A * 6/2000 Bachman et al. ..... 211/13.1
6,073,320 A * 6/2000 Salatin et al. ..... 27/27
6,105,793 A * 8/2000 Riga ..... 211/85.16
6,145,671 A * 11/2000 Riga et al. ..... 211/13.1
6,145,672 A * 11/2000 Bachman et al. ..... 211/13.1
6,161,705 A * 12/2000 Riga et al. ..... 211/85.16
6,189,710 B1 * 2/2001 Mason ..... 211/131.1
6,206,493 B1 * 3/2001 Sanchez-Levin et al. .... 312/125
D440,796 S * 4/2001 Riga ..... D6/468
6,276,034 B1 * 8/2001 Bachman et al. ..... 27/27
6,343,701 B2 * 2/2002 Riga et al. ..... 211/85.16
6,467,634 B1 * 10/2002 Pinco ..... 211/85.16
6,467,637 B2 * 10/2002 Riga ..... 211/94.01
6,585,118 B2 * 7/2003 Kellogg ..... 211/13.1
6,691,385 B2 * 2/2004 Bell et al. ..... 27/10
6,752,281 B1 * 6/2004 Mason et al. ..... 211/195
6,951,291 B2 * 10/2005 Kleanthis ..... 211/163
7,210,204 B2 * 5/2007 Groemminger et al. ..... 27/10
7,260,872 B2 * 8/2007 Schultz ..... 27/10
7,340,810 B2 * 3/2008 Acton et al. ..... 27/10
7,520,395 B2 * 4/2009 Bowers et al. ..... 211/85.16
2003/0000901 A1 * 1/2003 Salatin et al. ..... 211/85.16
2004/0200046 A1 * 10/2004 Biondo et al. ..... 27/2

FOREIGN PATENT DOCUMENTS

| | | |
|---|---|---|
| FR | 2674735 | 10/1992 |
| GB | 2224923 | 5/1990 |
| JP | 08150183 | 6/1996 |
| WO | 8402261 | 6/1984 |
| WO | 8904129 | 5/1989 |
| WO | 9635404 | 11/1996 |

OTHER PUBLICATIONS

Lajos Szabo, American funeral Director, Feb. 1997, The Three C's of Selection Rooms, 3 pages.
Selection Room Display In Public use Prior To Aug. 15, 1997, 3 Color Photographs.
Milso Industries, Milso Renaisance Center, Advertisement in The American Funeral Director, May 2003, 2 pages.

* cited by examiner

DISPLAY FOR A CASKET SELECTION ROOM

RELATED APPLICATIONS

This application is a divisional application of application Ser. No. 11/760,593 filed Jun. 8, 2007, U.S. Pat. No. 7,520,395 issued Apr. 21, 2009, which is a divisional application of application Ser. No. 10/757,431 filed Jan. 15, 2004 now abandoned, the entire disclosure of which is hereby incorporated by reference herein as if fully set forth in its entirety.

FIELD OF THE INVENTION

This invention relates generally to the funeral service industry, and more particularly to a display system facilitating the selection by a customer of a casket in a funeral home selection room.

BACKGROUND OF THE INVENTION

Funeral home casket selection rooms have evolved as those in the industry have attempted to better meet the funeral customers' needs. The "traditional" presentation of product in a funeral home selection room was to simply place each casket on a bier and open the head end cap or lid of the casket to permit viewing inside the casket. As many caskets as possible were displayed in a selection room in order to maximize the number of product choices for the customer. Unfortunately, such a "traditional" presentation results in what has been referred to as a "sea of caskets" visual effect, which can be both distressing or alarming and confusing to the customer.

Advances in the design of funeral home selection rooms have taken the form of providing a plurality of alcove structures, either of a "modular" construction or of a "stick built" construction, in the funeral home selection room. Each alcove structure includes a vertical back wall and a pair of vertical, spaced apart wing walls cooperating with the back wall to form an alcove. A soffit may span the upper front edges of the wing walls, and lighting, for example track lighting, may be incorporated into the soffit. A two-tier casket rack is located within the alcove, the lower tier of the casket rack being a roll out rack permitting the lower casket to be rolled out from under the upper casket and the casket lid opened for display of the lower casket. Tasteful signage and the like is mounted on the back wall above the caskets. Such a construction, which is the subject of the assignee's prior U.S. Pat. Nos. 5,405,017 and 5,524,394, both hereby incorporated by reference herein, increases the number of caskets which can be displayed in a funeral home selection room, as well as greatly improves the "look and feel" of the casket presentations, thereby reducing the clutter and confusion of the so-called "sea of caskets" effect and providing a feeling of comfort to the families.

New construction and renovation costs being what they are, there is an ever-increasing need to increase the product density displayable in the funeral home selection room, without sacrificing comfort, convenience and look and feel of the casket display systems of U.S. Pat. Nos. 5,405,017 and 5,524,394. To that end, the assignee's U.S. patent application Ser. No. 09/638,576, hereby incorporated by reference herein, discloses and claims a Display For A Casket Selection And/Or Viewing Room. That application discloses the display of a plurality of casket portions along with a plurality of casket information modules. Each information module corresponds to one of the casket portions displayed and houses an insert displaying samples of the various features of the particular casket, for example, a portion of the cap panel, a photo of the casket, a fabric swatch of the casket fabric, etc. To access and view the casket samples displayed on the insert, a door to the module must be opened, and the insert must be slid out of the module.

By way of further advances, the assignee's U.S. patent application Ser. No. 10/611,607, hereby incorporated by reference herein, discloses and claims a Display For A Casket Selection Room. That application discloses a display for a casket selection room comprising a wall, a plurality of casket portions displayed on the wall, and a plurality of casket information modules displayed on the wall. Each information module corresponds to one of the casket portions and includes a photo of the casket, a portion of a cap panel of the casket and/or a fabric swatch of the casket. The photo, portion of the cap panel and/or fabric swatch are visible to the customer without opening the information module. The casket selection display of U.S. patent application Ser. No. 10/611,607 thereby provides further advantages above and beyond the casket selection display disclosed in U.S. application Ser. No. 09/638,576, for example obviating the need to open a door of the casket information module and remove the casket information insert in order to be able to view the same.

It is desirable to provide still further improvements in the area of casket display and selection.

SUMMARY OF THE INVENTION

In one aspect, the present invention is a display for a casket selection room comprising a base, a first display portion mounted to the base, a plurality of casket portions representing a plurality of casket choices from which a customer may select mounted to the first display portion, a second display portion mounted to the first display portion, and a plurality of casket ornaments representing a plurality of ornament choices from which the customer may select mounted to the second display portion.

In another aspect, the present invention is a display for a casket selection room comprising a base, a first display portion movably mounted to the base for swiveling movement relative thereto about a generally vertical axis, a plurality of casket portions representing a plurality of casket choices from which a customer may select mounted to the first display portion, a second display portion movably mounted to the first display portion for swiveling movement relative thereto about a generally vertical axis, and a plurality of casket ornaments representing a plurality of ornament choices from which the customer may select mounted to the second display portion.

In yet another aspect, the present invention is a display for a casket selection room comprising a base, a first display portion mounted to the base, a plurality of casket portions representing a plurality of casket choices from which a customer may select mounted to the first display portion, a plurality of casket information modules mounted on the first display portion, each of the information modules corresponding to one of the plurality of casket portions and including at least one of a photo of the casket, a portion of a cap panel of the casket and a fabric swatch of the casket, a second display portion mounted to the first display portion, and a plurality of casket ornaments representing a plurality of ornament choices from which the customer may select mounted to the second display portion.

In still another aspect, the present invention is a display for a casket selection room comprising a base, a first display portion movably mounted to the base for swiveling movement relative thereto about a generally vertical axis, a plurality of casket portions representing a plurality of casket choices from which a customer may select mounted to the first display portion, a plurality of casket information modules mounted on the first display portion, each of the information modules corresponding to one of the plurality of casket portions and including at least one of a photo of the casket, a portion of a cap panel of the casket and a fabric swatch of the casket, a second display portion movably mounted to the first display portion for swiveling movement relative thereto about a generally vertical axis, and a plurality of casket ornaments representing a plurality of ornament choices from which the customer may select mounted to the second display portion.

The first portion can be four-sided with each side having one casket portion mounted thereto. The second portion can also be four-sided with each side having four ornaments mounted thereto. The display can thereby present the customer with 64 casket choices from which the customer may select. The display can have a height of about 72 inches. The base of the display can also be four-sided. Each side of the base can be about 18 inches. The ornaments can be casket shell corner ornaments adapted to be mounted to each corner of a four-cornered casket shell.

The casket information module can comprise an enclosure and an information insert movable into and out of the enclosure. The enclosure can include a door pivotable to and between a closed position and an open position. The information insert can comprise a first portion and a second portion, the first and second insert portions being movably mounted to the enclosure for translational movement into and out of the enclosure, the second insert portion being movably mounted to the first insert portion for pivoting movement therebetween, such that the second insert portion can be pulled out of the enclosure and then pivoted 90° such that the contents of the information insert then face the customer. The second insert portion can be fabricated at least in part of a transparent material and can comprise a first pocket having upper and lower edges, a second pocket attached to the upper edge of the first pocket, and a third pocket attached to the lower edge of the first pocket. The first pocket can include therein a portion of a cap panel of the casket, the second pocket can include therein a photo of the casket and the third pocket can include therein a fabric swatch of the casket.

In a further aspect, a display for a funerary item selection room comprises a first display portion, a plurality of first funerary items representing a plurality of first funerary item choices from which a customer may select mounted to the first display portion, a second display portion mounted to the first display portion, and a plurality of second funerary items representing a plurality of second funerary item choices from which the customer may select mounted to the second display portion, the first and second funerary items adapted to be used in combination.

The display can include a base, and the first display portion can be mounted to the base. The first display portion can be movably mounted to the base for swiveling movement relative thereto about a generally vertical axis, and the second display portion can be movably mounted to the first display portion for swiveling movement relative thereto about a generally vertical axis. The display can further include a plurality of funerary item information modules mounted on at least one of the first and second display portions, each of the information modules corresponding to one of the plurality of funerary items and including information regarding the funerary items. The first funerary items can be casket portions and the second funerary items can be casket ornaments. The first funerary items can be casket portions and the second funerary items can be personalization props. The first funerary items can be cremation urns and the second funerary items can be personalization props. The display can further include graphics. The graphics can be computer generated or printed. The graphics can depict life interests of the deceased, product features or funeral/memorial service arrangement information.

In a further aspect, a display for a casket selection room comprises a first display portion, a plurality of casket portions representing a plurality of casket choices from which a customer may select mounted to the first display portion, a second display portion mounted to the first display portion, a plurality of casket ornaments representing a plurality of ornament choices from which the customer may select mounted to the second display portion and a connection mechanism for removably securing the plurality of ornaments to the second display portion and to the plurality of casket portions. A customer can thereby remove a chosen ornament from the second display portion and removably secure the chosen ornament to a chosen casket portion.

The casket selection display of the present invention thereby provides further advantages above and beyond prior casket selection displays. In the preferred embodiment wherein one display portion includes 4 casket portions and the other display portion includes 16 ornaments, the display provides a funeral director the ability to display to a customer 64 different caskets, all within a display floor area of only 2.25 square feet. In the further preferred embodiment wherein the display portions are swivelable relative to one another, the ability to so swivel the display portions permits a customer to position a chosen ornament closely adjacent a chosen casket portion thereby giving the customer a general idea of how the casket and ornament combination will appear. In the still further preferred embodiment wherein the casket display portion includes the casket information module, the information module provides the customer with the ability to conveniently access the interior components of the casket portion on the information insert. In the still further preferred embodiment wherein the ornaments are removably secured to the display and to the casket portions via the same mechanism, a customer can determine exactly how the combination of casket and ornament will appear by simply removing the chosen ornament from the display and attaching it to the chosen casket portion.

These and other advantages of the present invention will become more readily apparent during the following detailed description taken in conjunction with the drawings herein, in which:

DETAILED DESCRIPTION OF THE INVENTION

Figure 1:
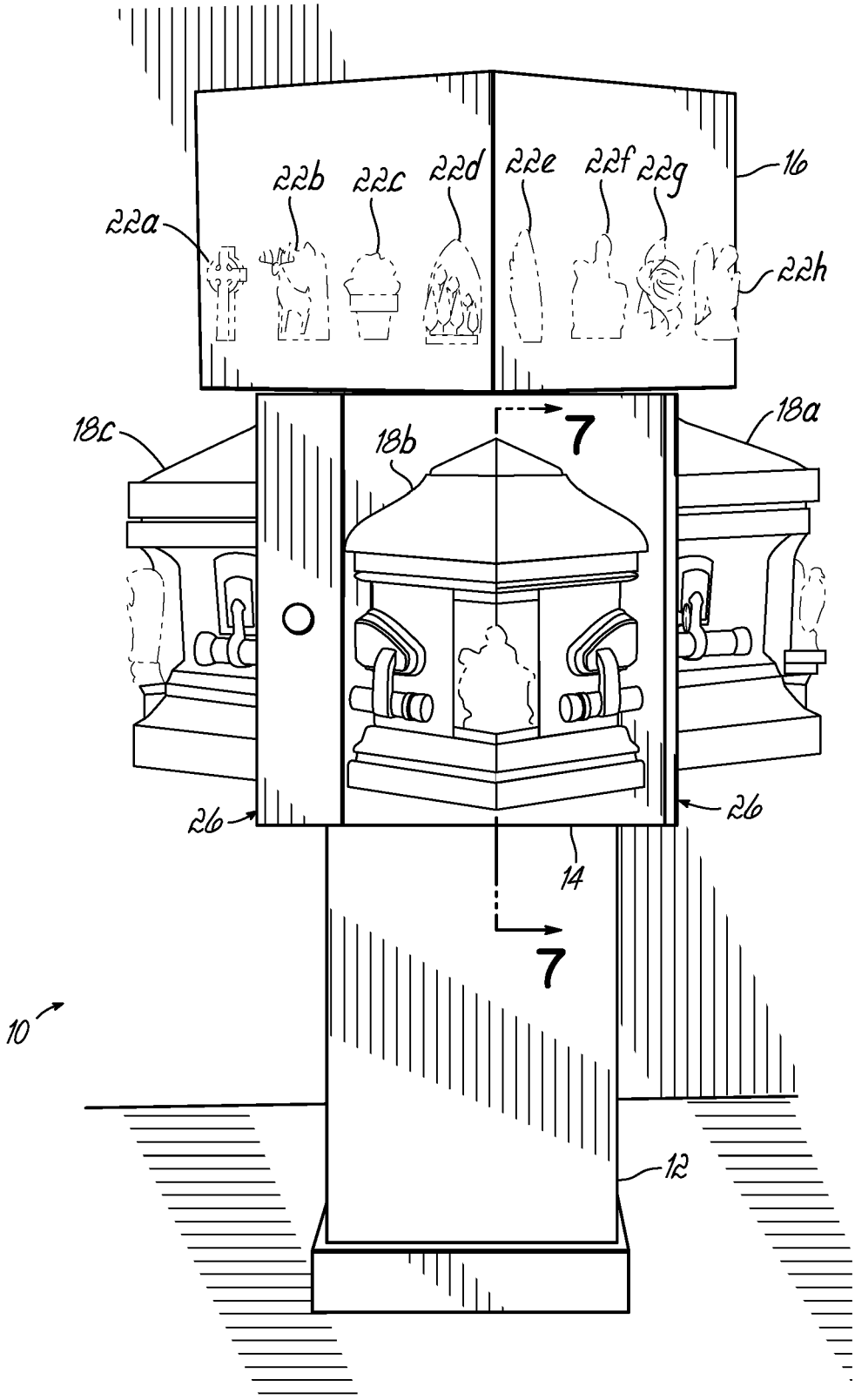
FIG. 1 is a front view of the casket selection display of the present invention.
Figure 2:
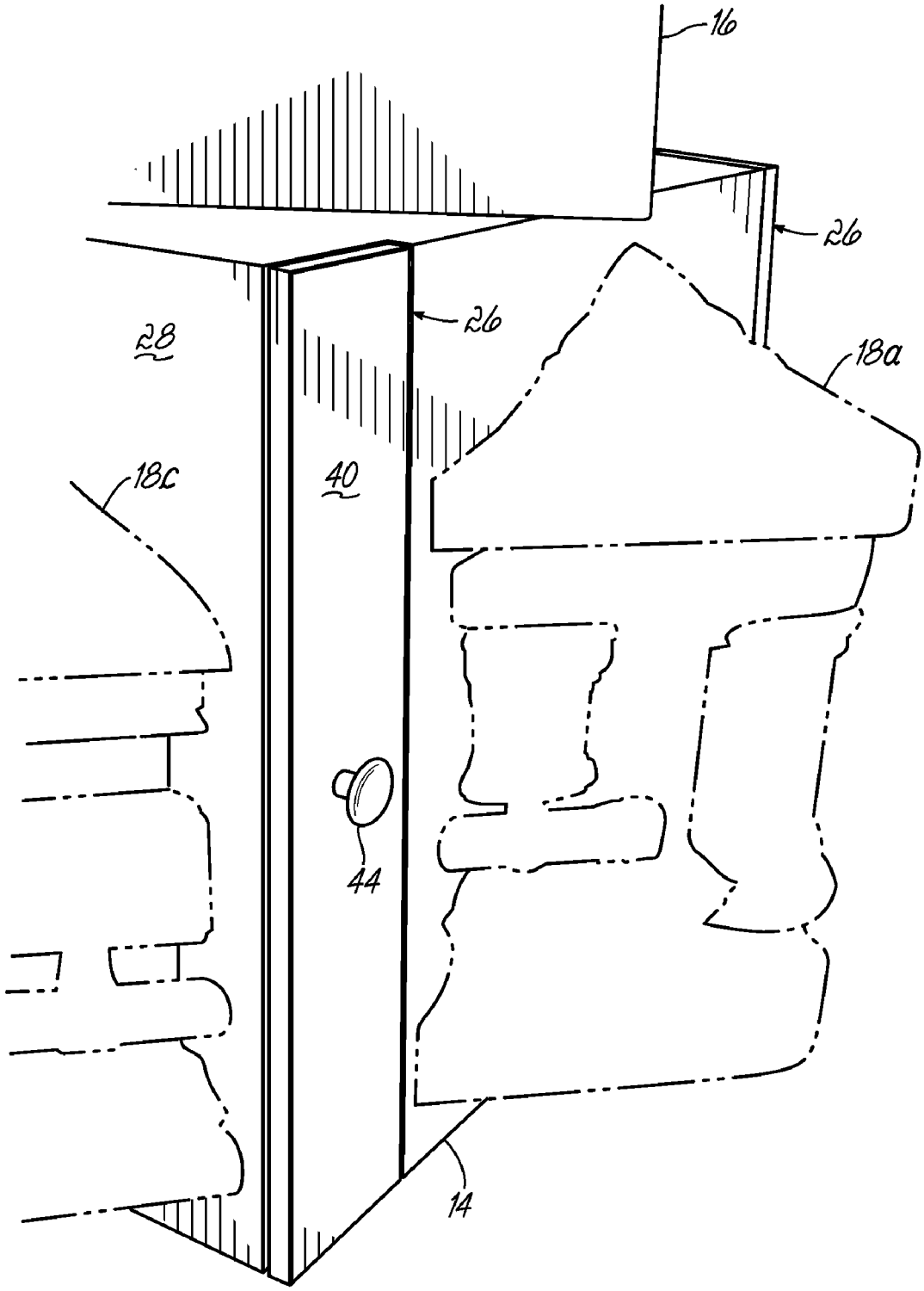
FIG. 2 is an enlarged perspective view of the central portion of the display of FIG. 1.
Figure 3:
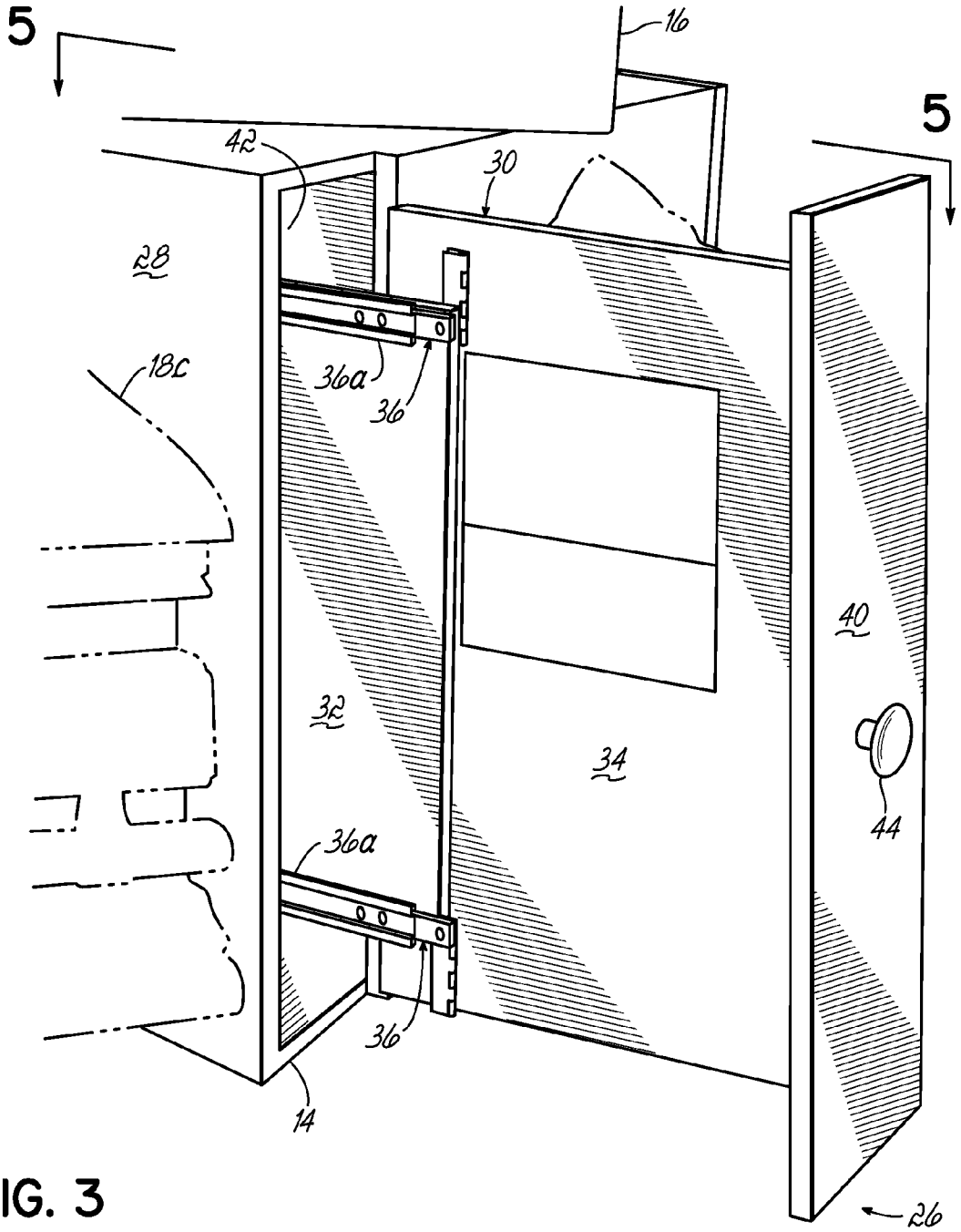
FIG. 3 is a view similar to FIG. 2 illustrating the information module of FIG. 2 with door open and insert pulled out.

Referring first to FIGS. 1 and 2, there is illustrated a display 10 according to the principles of the present invention. The display 10 can be installed in the selection room of a funeral home for facilitating the selection of a casket by a customer or a family member. The display 10 can include a base 12, a first display portion 14 mounted to the base 12 and a second display portion 16 mounted to the first display portion 14.

Figure 7:
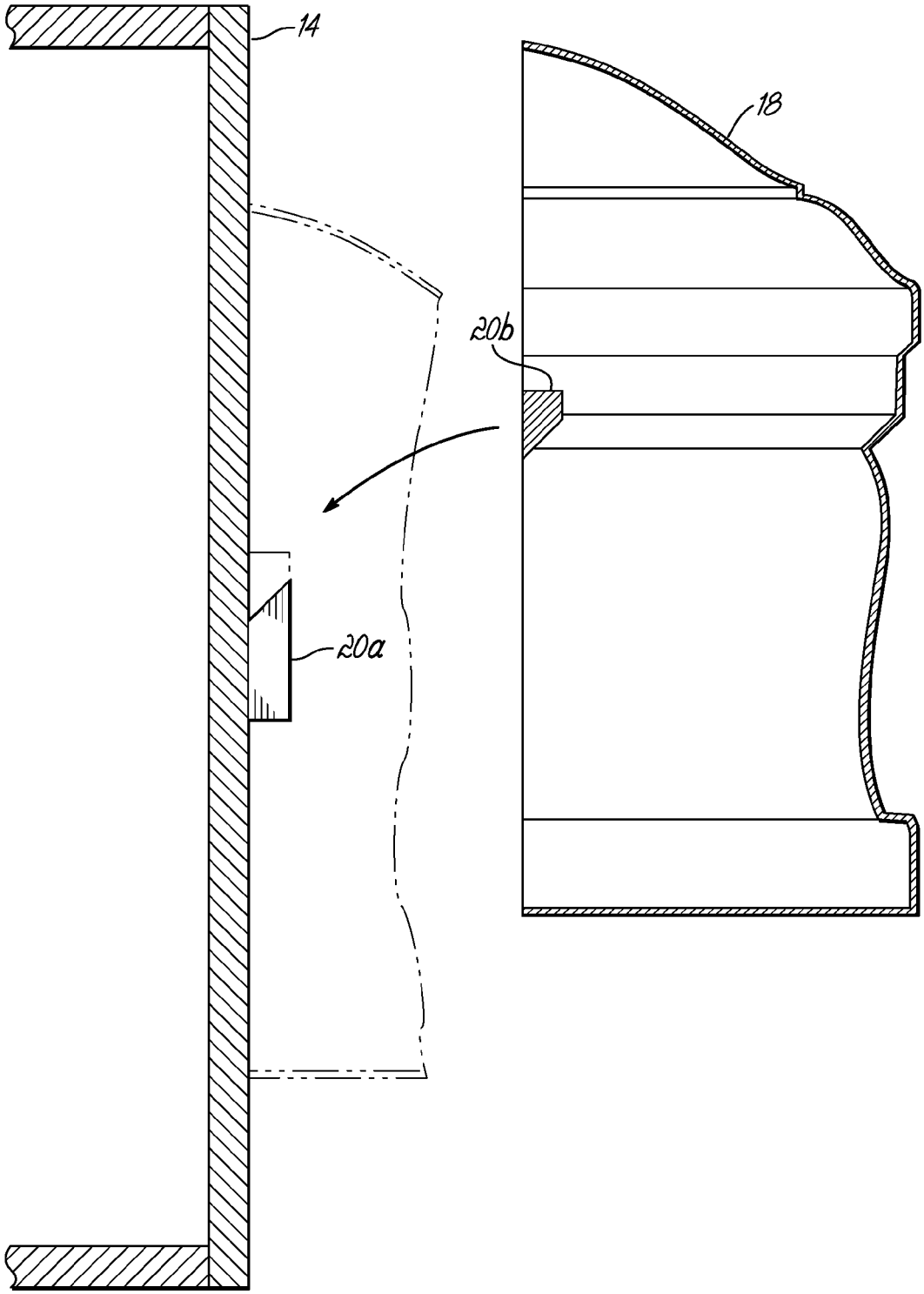
FIG. 7 is a view taken along line 7-7 of FIG. 1 illustrating the interconnection of a casket portion with the central portion of the display.

One of the display portions, for example first display portion 14, can be utilized to display a plurality of casket portions 18*a-c* (display 10 would preferably include a fourth casket portion, though not shown in the drawings). Casket portions 18*a-c* represent a plurality of different full-size caskets from which a customer may choose. For example, the casket portions 18*a-c* could all be wood caskets, with each wood casket being fabricated of a different wood, for example, mahogany, walnut, cherry, oak, maple, pecan, pine, hardwood, etc. Alternatively, the casket portions 18*a-c* could all be metal caskets, with each metal casket being fabricated of a different metal, for example, bronze, copper, stainless steel, steel, etc. Wood casket portions 18*a-c* can be the Woodbridge Pecan™, the Cameron Oak™, the Pearson Cherry™ and the Hartfield™, commercially available from the assignee. Metal casket portions 18*a-c* can be the Golden Sand™, the Golden Midnight™, the Golden Pearl™ and the Silver Saphire™, also commercially available from the assignee. The casket portions 18*a-c* can be of any geometry desired, but will likely be either a 45° corner cut (shown in the drawings), a right angle corner cut or a butt end cut. The casket portions 18*a-c* can be attached to first display portion with the use of co-operating angled cleats 20*a*, 20*b*, as shown in FIG. 7.

The other display portion, second display portion 16, can be utilized to display a plurality of casket ornaments, for example casket shell corner ornaments 22*a-h*. Corner ornaments 22*a-h* represent a plurality of different casket corner ornaments from which the customer may choose. Corner ornaments 22*a-h* can be the LifeSymbols® line of casket corner ornaments commercially available from the assignee and described and claimed in the assignee's U.S. Pat. No. 6,591,466 titled Quick Change Casket Corner, hereby incorporated by reference herein. The ornaments 22*a-h* can be attached to second display portion 16, and to the casket portions 18*a-c*, via the mechanisms described and claimed in U.S. Pat. No. 6,591,466. By swiveling the displays 14 and 16 relative to one another, a customer can position a chosen ornament closely adjacent a chosen casket portion to obtain a general idea of how the casket and ornament combination will appear. Then, the customer can actually remove the chosen ornament from the display 16 and attached it to the chosen casket portion on display 14 to determine exactly how the combination of casket and ornament will appear.

As illustrated, each of the base 12, first display portion 14 and second display portion 16 is four-sided. The first display portion 14 has one casket portion per each side thereof. The second display portion 16 has four ornaments per each side thereof. A customer therefore is presented with 64 casket choices from which to choose. The display 10 is preferably 72 inches tall, and the base 12 is preferably 18 inches on a side. Thus, the display 10, as illustrated, provides a funeral director with the ability to display to a customer 64 different caskets, all within a display floor area of only 2.25 square feet.

Figure 6:
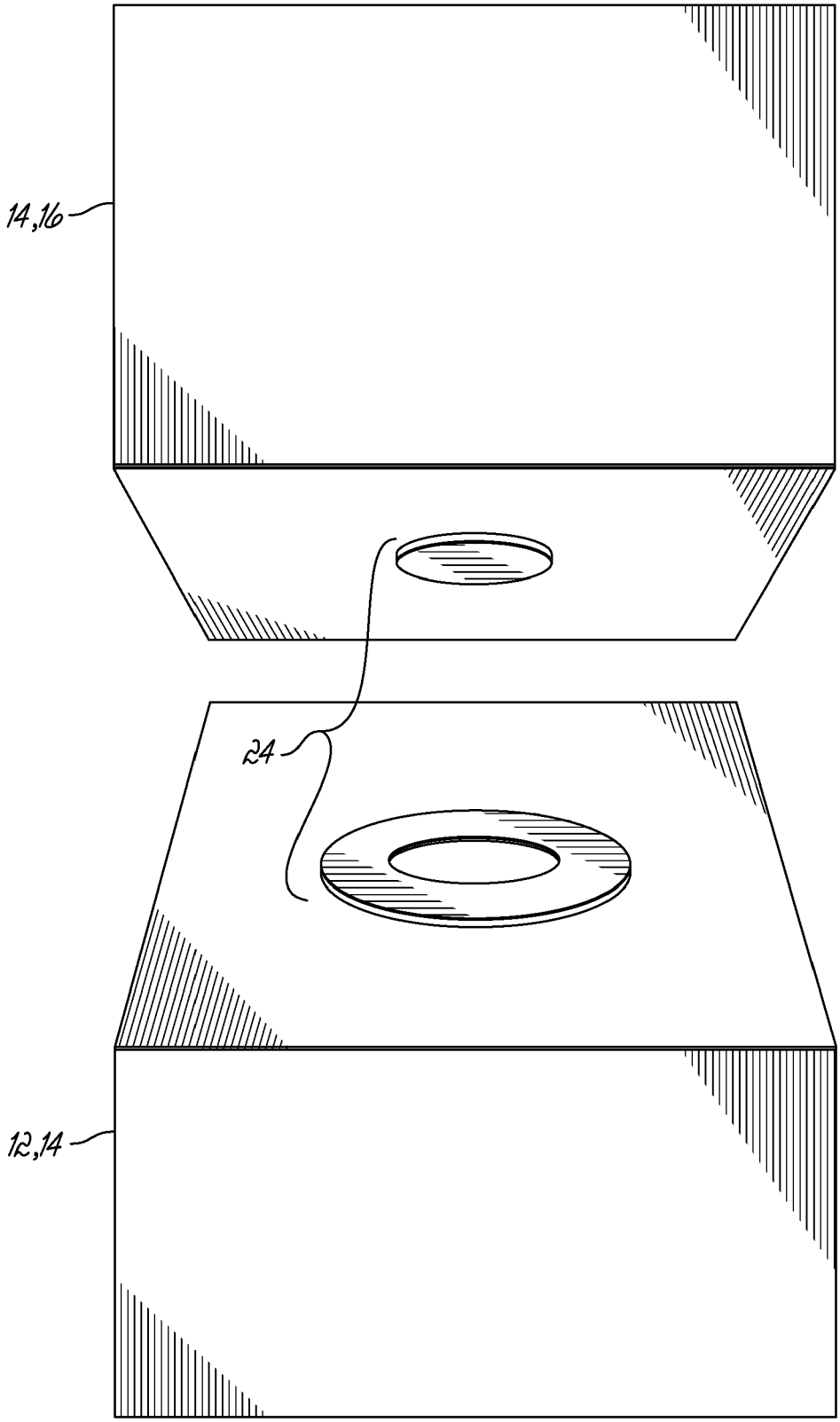
FIG. 6 is an exploded perspective view of the interconnection of the upper portion of the display to the central portion of the display.

Referring to FIG. 6, base 12 and first display portion 14, and first display portion 14 and second display portion 16, can be mounted together for swiveling movement of the first display portion 14 relative to the base 12, and of the second display portion 16 relative to the first base portion 14, about a generally vertical axis(es). A lazy susan 24 can be utilized to so mount the base, first display portion and second display portion together.

Figure 4:
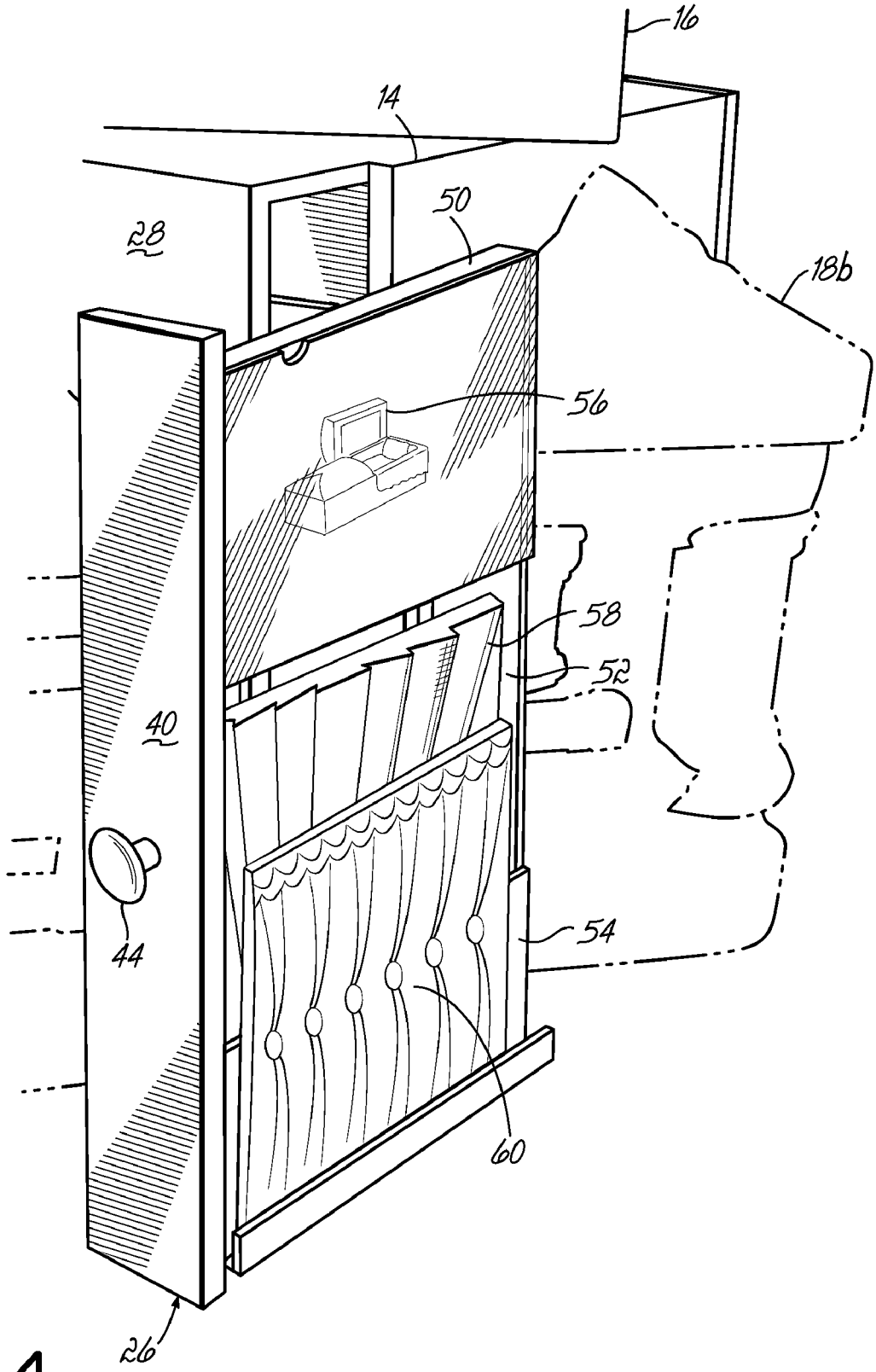
FIG. 4 is a view similar to FIG. 3 illustrating the insert pivoted 90° relative to its direction of movement in going to the position of FIG. 3 from the position of FIG. 2.
Figure 5A:
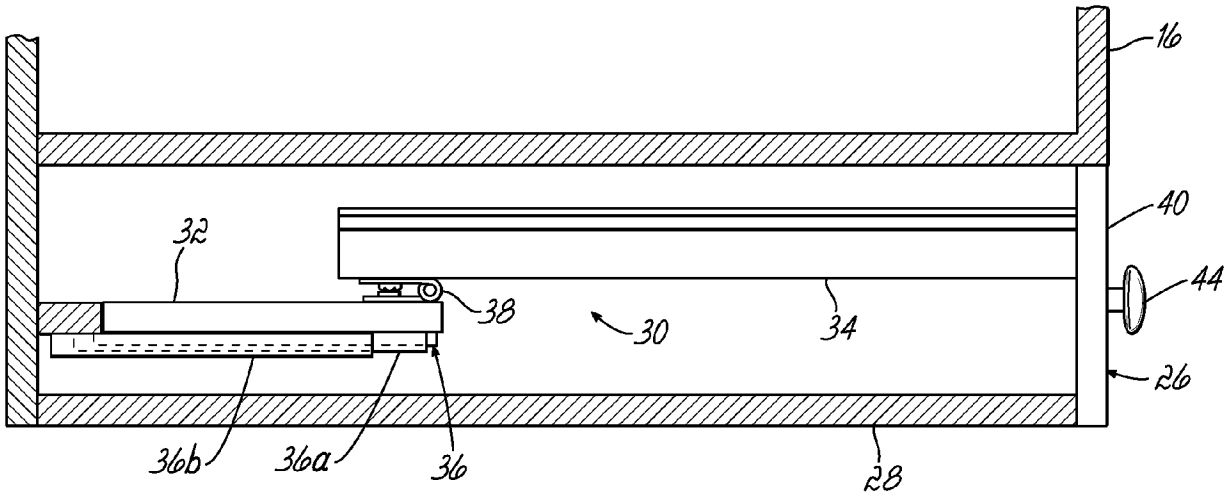
FIGS. 5A-5C are views taken along 5-5 of FIG. 3 illustrating the FIGS. 2-4 positions of the insert of the information module.
Figure 5B:
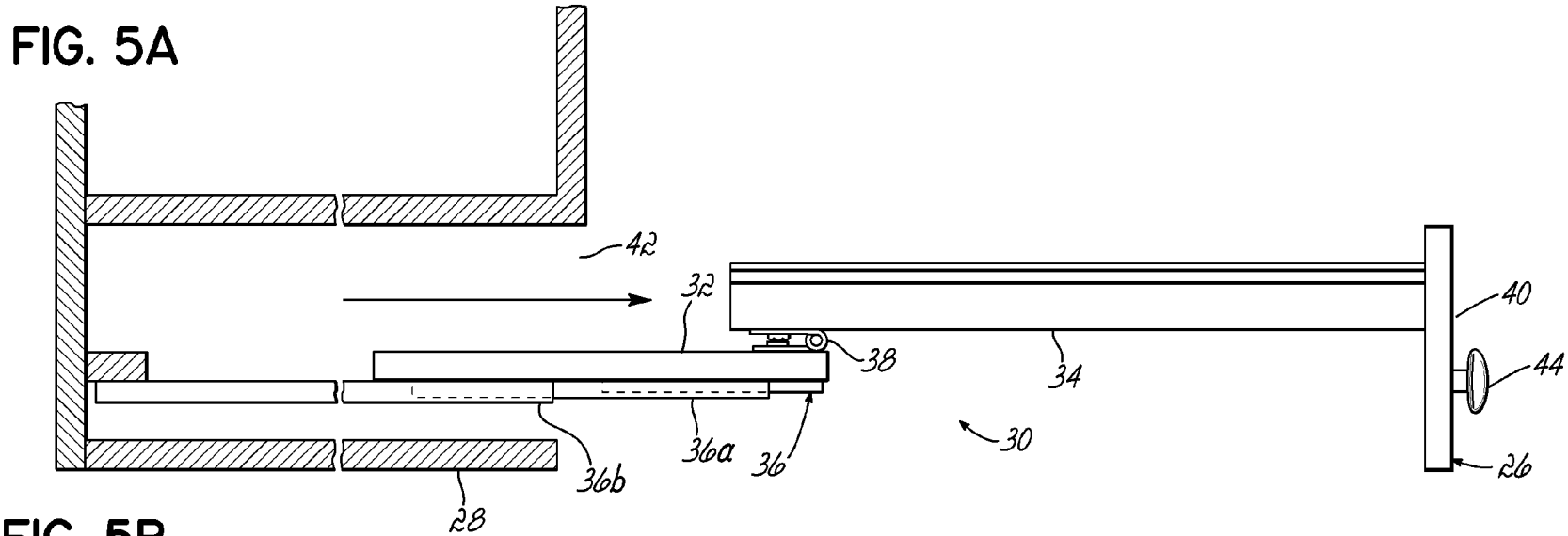
Figure 5C:
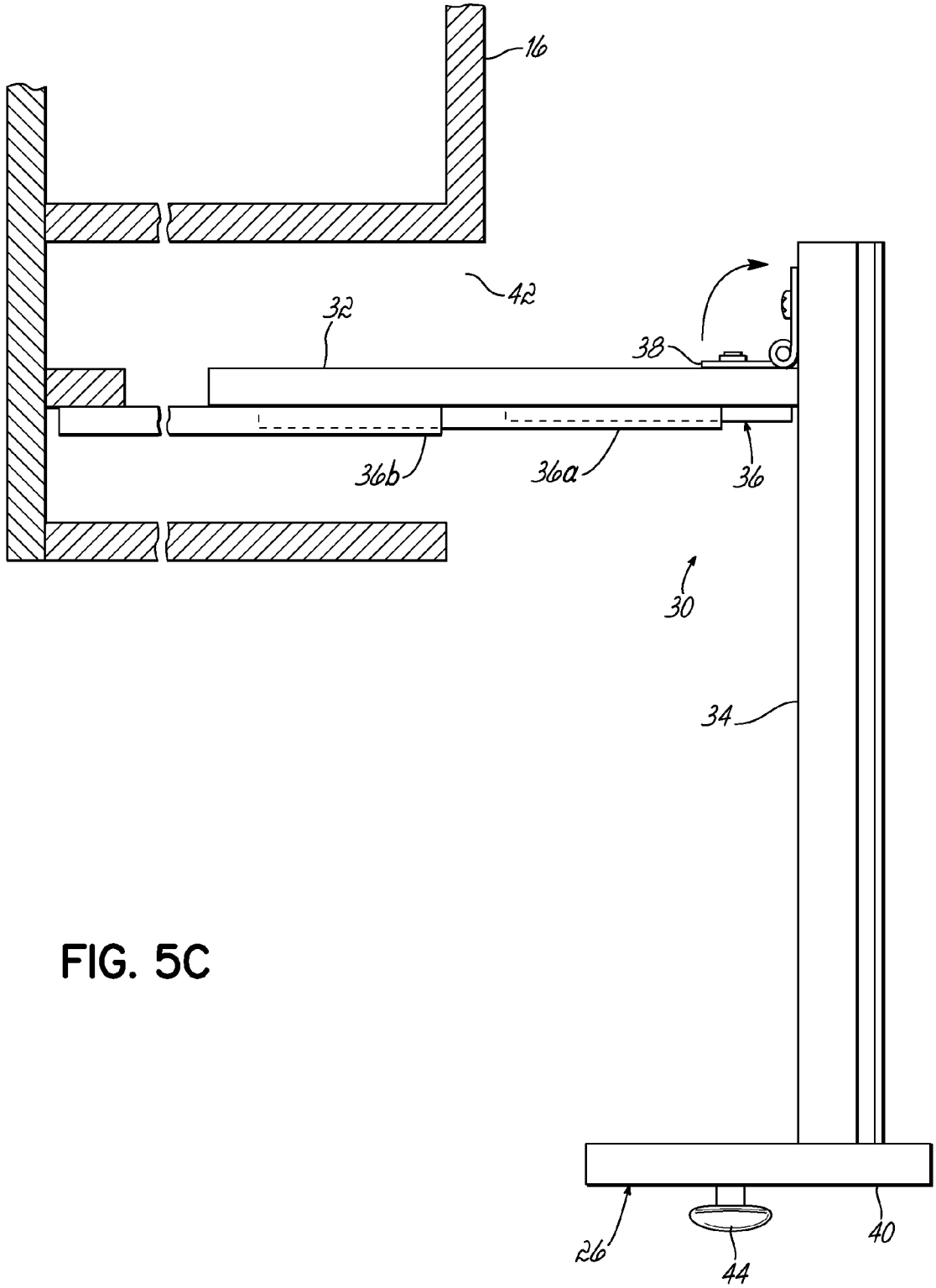

Referring now to FIGS. 1-4, and in particular to FIGS. 5A-C, a plurality of casket information modules 26 can be mounted to the first display portion 14. Each information module 14 would correspond to one of the casket portions 18*a-c*, and could include information about the features of the casket. More particularly, information module 26 can comprise an enclosure 28 formed in second display portion 14 and an information insert 30 movable into and out of the enclosure 28. Insert 30 can comprise a first portion 32 and a second portion 34. The first and second portions 32 and 34 can be movably mounted to the enclosure 28 for translational movement into and out of the enclosure 28. For example, first portion 32 can be mounted to enclosure 28 via a pair of slide mechanisms 36, 36 having portions 36*a*, 36*b* which slide relative to one another. In addition, second insert portion 34 can be movably mounted to first insert portion 32 for pivoting movement therebetween, as by a pair of hinges 38, 38, such that second insert portion, once pulled out of enclosure 28, can be pivoted 90° such that its contents then face a customer. Second insert portion 34 can also include a front panel 40 to cover the opening 42 of the enclosure 28, and a knob 44 facilitating pulling the insert 30 out of the enclosure 28.

Describing the second portion 34 of the information insert 30 in more detail, and referring now back to FIG. 4, the second portion 34 is preferably fabricated, at least in part, of a transparent material such as acrylic and includes a first pocket 50, a second pocket 52 and a third pocket 54. The first pocket 50 can include a photo 56 of the casket, the second pocket 52 can include a portion 58 of the cap panel of the casket and the third pocket 54 can include a fabric swatch 60 of the fabric of the casket. Pockets 50, 52 and 54, and photo 56, cap panel portion 58 and fabric swatch 60, are sized such that the customer can readily see, access, touch and feel them. Additionally, cards (not shown) containing printed information can be positioned in the pockets to thereby provide additional information about the casket.

Those skilled in the art will readily recognize numerous adaptations and modifications which can be made to the present invention which will result in an improved selection room display, yet all of which will fall within the spirit and scope of the present invention as defined in the following claims. For example, the base of the display of the present invention could include graphics and/or other casket features, such as the MemorySafe® casket drawer, disclosed and claimed in the assignee's U.S. Pat. Nos. 5,611,124 and 5,727,291 titled Casket Having Memorabilia Compartment, hereby incorporated by reference herein.

In addition, computer equipment or computer driven displays such as plasma screens can be incorporated in the display to enhance and expand the presentation of products and accessories. Graphics, whether printed or computer generated, depicting life interests of the deceased, product features and/or funeral/memorial service arrangement information can be included in the display.

Items other than caskets and casket ornaments could be displayed on the display of the present invention. Theme specific personal interests such as patriotism, golfing, gardening and the like could be presented and promoted via the display of the present invention by displaying thereon "personalization props" such as flag cases, armed services medal cases, and/or other memorabilia representing hobbies or life interests of the deceased, including, but not limited to, nature, family, religion, crafts and/or sports. Cremation urns and lifestyle/personal interest items can be displayed on the display of the present invention. In that way, the combination of these funerary items is thus promoted to create more meaningful memorial services involving cremation. Accordingly, the invention shall embrace all such variations and is to be limited only by the scope of the following claims and their equivalents.

What is claimed is:

1. A display for a casket selection room comprising:

a base, a first display portion movably mounted to said base for swiveling movement relative thereto about a generally vertical axis, a plurality of casket portions representing a plurality of casket choices from which a customer may select mounted to said first display portion, at least one of said casket portions configured to have a casket ornament removably mounted thereto, a plurality of casket information modules mounted on said first display portion, each of said information modules corresponding to one of said plurality of casket portions and including at least one of a photo of the casket, a portion of a cap panel of the casket and a fabric swatch of the casket, a second display portion movably mounted to said first display portion for swiveling movement relative thereto about a generally vertical axis, and a plurality of casket ornaments representing a plurality of ornament choices from which the customer may select removably mounted to said second display portion, whereby said casket ornaments may be selectively detached from said second display portion and attached to said at least one casket portion to simulate a desired casket configuration.

2. The display of claim 1 wherein said first portion is four-sided and wherein each said side of said first portion has one said casket portion mounted thereto.

3. The display of claim 1 wherein said second portion is four-sided and wherein each said side of said second portion has four said ornaments mounted thereto.

4. The display of claim 1 wherein:

said first portion is four-sided and has one said casket portion mounted on each said side thereof, and said second portion is four-sided and has four said ornaments mounted on each said side thereof, said display thereby presenting the customer with 64 casket choices from which the customer may select.

5. The display of claim 4 wherein said display has a height of about 72 inches.

6. The display of claim 4 wherein said base is four-sided.

7. The display of claim 6 wherein each said side of said base is about 18 inches.

8. The display of claim 1 wherein said ornaments are casket shell corner ornaments adapted to be mounted to each corner of a four-cornered casket shell.

9. The display of claim 1 wherein each said casket information module comprises an enclosure and an information insert movable into and out of said enclosure.

10. The display of claim 9 wherein said enclosure includes a door pivotable to and between a closed position and an open position.

11. The display of claim 1 wherein all of said casket portions are configured to have a casket ornament removably mounted thereto.

12. A display for a casket selection room comprising:

a base, a first display portion movably mounted to said base for swiveling movement relative thereto about a generally vertical axis, a plurality of casket portions representing a plurality of casket choices from which a customer may select mounted to said first display portion, a plurality of casket information modules mounted on said first display portion, each of said information modules corresponding to one of said plurality of casket portions and including at least one of a photo of the casket, a portion of a cap panel of the casket and a fabric swatch of the casket, a second display portion movably mounted to said first display portion for swiveling movement relative thereto about a generally vertical axis, and a plurality of casket ornaments representing a plurality of ornament choices from which the customer may select mounted to said second display portion;

wherein each said casket information module comprises an enclosure and an information insert movable into and out of said enclosure;

wherein said enclosure includes a door pivotable to and between a closed position and an open position;

wherein said information insert comprises a first portion and a second portion, said first and second insert portions movably mounted to said enclosure for translational movement into and out of said enclosure, said second insert portion movably mounted to said first insert portion for pivoting movement therebetween, whereby said second insert portion can be pulled out of said enclosure and then pivoted 90° such that the contents of said information insert then face the customer.

13. The display of claim 12 wherein said second insert portion is fabricated at least in part of a transparent material and comprises:

a first pocket having upper and lower edges, a second pocket attached to said upper edge of said first pocket, and a third pocket attached to said lower edge of said first pocket.

14. The display of claim 13 wherein said first pocket includes therein a portion of a cap panel of the casket, said second pocket includes therein a photo of the casket and said third pocket includes therein a fabric swatch of the casket.

* * * * *